US005987649A

United States Patent [19]

Robertson

[11] Patent Number: 5,987,649

[45] Date of Patent: Nov. 23, 1999

[54] CAP INSERT

[76] Inventor: Richard K. Robertson, P.O. Box 877, Miami, Okla. 74355

[21] Appl. No.: 09/036,507

[22] Filed: Mar. 6, 1998

[51] Int. Cl.[6] ..... A42B 1/00

[52] U.S. Cl. ..... 2/195.5; 2/181; 2/181.8

[58] Field of Search ..... 2/175.4, 195.5, 2/181.2, 181.4, 181.8, 181

[56] References Cited

U.S. PATENT DOCUMENTS

| | | | |
|---|---|---|---|
| 999,322 | 8/1911 | Levin . | |
| 1,422,366 | 7/1922 | Leger | 2/195.5 |
| 1,501,507 | 7/1924 | Wetherbee . | |
| 1,725,425 | 8/1929 | Steingold | 2/181 |
| 2,445,230 | 7/1948 | Mattsson et al. | 2/195 |
| 2,675,558 | 4/1954 | Richard | 2/180 |
| 2,704,847 | 3/1955 | MacPherson | 2/195 |
| 2,740,567 | 4/1956 | Kaufman | 223/84 |
| 3,133,289 | 5/1964 | Lipschultz | 2/195 |
| 4,637,077 | 1/1987 | Henschel | 2/185 B |
| 4,790,034 | 12/1988 | Pass | 2/195 |
| 5,481,760 | 1/1996 | Wood, Jr. | 2/195.5 |
| 5,647,064 | 7/1997 | Whittaker | 2/195.5 |
| 5,887,284 | 3/1999 | Simmons | 2/181.4 |

*Primary Examiner*—Diana L. Oleksa
*Attorney, Agent, or Firm*—William R. Sharp

[57] ABSTRACT

A cap insert comprises an elongated sheet which is flexible but sufficiently rigid for use as a shaping insert in a billed cap. The sheet is substantially planar in a relaxed state and includes a central portion, opposing tapered portions, and opposing leg portions. The sheet fits inside a billed cap around the sweatband, and successfully returns an old billed cap to its proper shape.

12 Claims, 2 Drawing Sheets

CAP INSERT

BACKGROUND OF THE INVENTION

This invention relates to an insert for a billed cap.

A billed cap comprises a head covering and a bill extending therefrom. According to a common design, the head covering has a front portion (adjacent to the bill) with the necessary circumferential curvature, but with little or no inward curvature. Any subsequent references to a billed cap is understood to be of this design. To maintain the desired shape, the manufacturer typically stitches a heavy, relatively stiff backing material inside the front portion of the head covering. However, after long use and multiple washings, this backing material loses its stiffness. Consequently, the front portion of the head covering tends to collapse and curve inwardly, giving a sloppy and undesirable appearance that may make the cap unwearable.

SUMMARY OF THE INVENTION

It is, therefore, an object of the invention to provide an article which will return an old billed cap to its desired shape and maintain this shape.

The above object is realized by a cap insert comprising an elongated sheet having a longitudinal axis, being flexible but sufficiently rigid for use as a shaping insert in a billed cap, and being substantially planar in a relaxed state, wherein the sheet includes: longitudinally opposed ends; a first edge longitudinally extending between the ends; and a second edge extending between the ends and transversely spaced from the first edge, wherein the second edge has (i) a longitudinally extending central edge portion centrally positioned with respect to the first edge and the ends so as to define a central sheet portion, having a central width, between the central edge portion and first edge, and (ii) longitudinally opposed and substantially identical side edge portions, wherein each side edge portion has (a) a tapered side edge subportion extending outwardly from the central edge portion so as to define a tapered sheet portion between the tapered side edge subportion and first edge which decreases in width from the central width to a width hereafter denoted as the leg width, and (b) a longitudinally extending leg side edge subportion extending outwardly from the tapered side edge subportion to an end so as to define a leg sheet portion, having the leg width, between the leg side edge subportion and first edge.

The following detailed description discusses features of the invention and advantages thereof in more detail, and discusses the manner in which the cap insert is positioned in a billed cap.

BRIEF DESCRIPTION OF THE DRAWINGS

FIGS. 1 and 2 are approximately ¼ actual scale, and FIGS. 3 and 4 are approximately full actual scale.

DETAILED DESCRIPTION OF THE INVENTION

Figure 1:
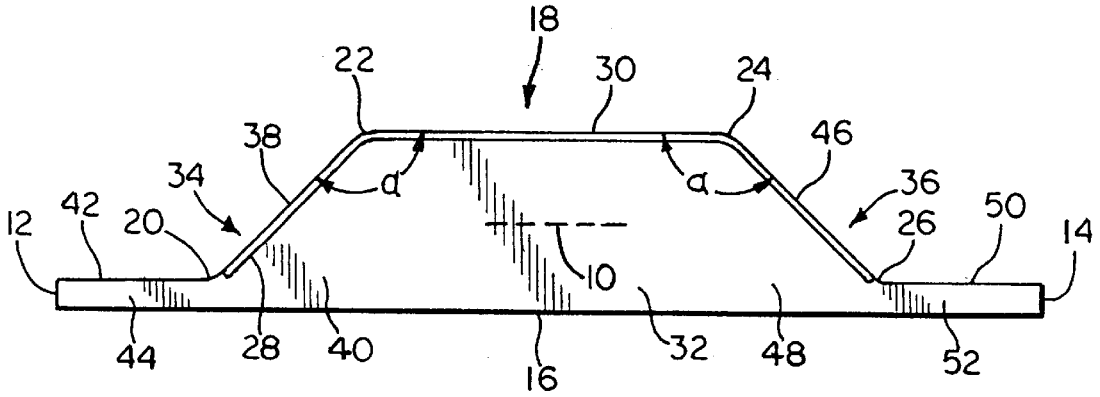
FIGS. 1 and 2 show opposing surfaces of a cap insert in accordance with a preferred embodiment of the invention.
Figure 2:
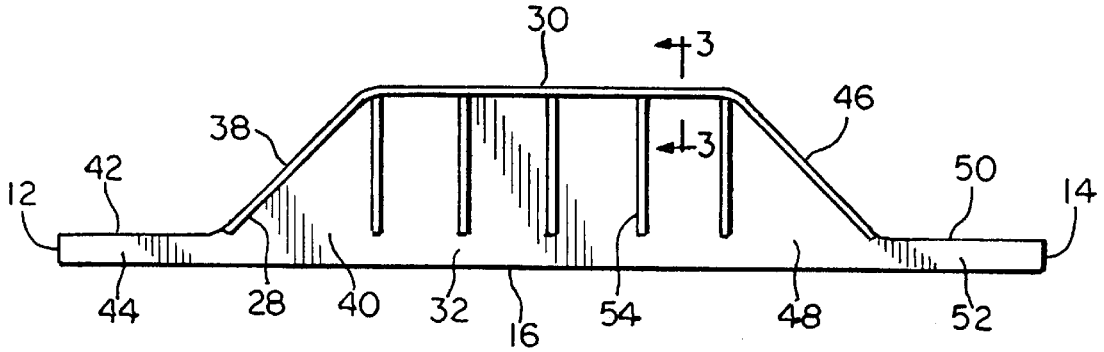

Referring to FIGS. 1 and 2, the illustrated cap insert comprises an elongated sheet which is flexible but sufficiently rigid for use as a shaping insert in a billed cap. It is also desirable that the material of the sheet is water repellent, resilient, and highly durable. A plastic material is preferred, such as polyethylene. As shown, the sheet is substantially planar in a relaxed state.

Referring now to FIG. 1 specifically, the sheet has a longitudinal axis 10. All lengths hereafter discussed are measured parallel to longitudinal axis 10, and all widths are measured transverse to (perpendicular to) longitudinal axis 10. The sheet includes longitudinally opposed ends 12 and 14, a preferably substantially straight edge 16 longitudinally extending between ends 12 and 14, and an edge 18 extending between ends 12 and 14 and transversely spaced from edge 16. Edge 18 has corners 20, 22, 24, and 26, which are preferably slightly rounded as shown. A cord 28 defines portions of edge 18, which are hereafter described, and helps prevent creasing of the sheet.

Edge 18 has (i) a preferably substantially straight central edge portion 30 longitudinally extending between corners 22 and 24 and centrally positioned with respect to edge 16 and ends 12 and 14 so as to define a central sheet portion 32, having a central width, between central edge portion 30 and edge 16, and (ii) longitudinally opposed and substantially identical side edge portions 34 and 36.

Side edge portion 34 has (a) a tapered side edge subportion 38, substantially straight in the illustrated embodiment, extending outwardly from corner 22 so as to define a tapered sheet portion 40 between tapered side edge subportion 38 and edge 16 which decreases in width from the central width to a width hereafter denoted as the leg width, and (b) a preferably substantially straight, longitudinally extending leg side edge subportion 42 extending outwardly from corner 20 to end 12 so as to define a leg sheet portion 44, having the leg width, between leg side edge subportion 42 and edge 16.

Side edge portion 36 has (a) a tapered side edge subportion 46, substantially straight in the illustrated embodiment, extending outwardly from corner 24 so as to define a tapered sheet portion 48 between tapered side edge subportion 46 and edge 16 which decreases in width from the central width to the leg width, and (b) a preferably substantially straight, longitudinally extending leg side edge subportion 50 extending outwardly from corner 26 to end 14 so as to define a leg sheet portion 52, having the leg width, between leg side edge subportion 50 and edge 16.

As shown, an obtuse angle $\alpha$ is defined between central edge portion 30 and tapered side edge subportion 38, and also between central edge portion 30 and tapered side edge subportion 46. Angle $\alpha$ is preferably about 120–150°, more preferably about 130–140°, and most preferably about 135°.

The ratio of the length of each tapered sheet portion to the decrease in width from the central width to the leg width is preferably about 0.5–1.7:1, more preferably about 0.8–1.2:1, and most preferably about 1:1.

Referring to FIG. 2, the illustrated surface of central sheet portion 32 is shown as having a number of transversely extending and longitudinally spaced ribs, such as indicated at 54. The ribs serve to stiffen central sheet portion 32 transversely without impairing longitudinal flexibility. This is desirable in attaining the proper shape for a billed cap, as will be more apparent below.

Figure 3:
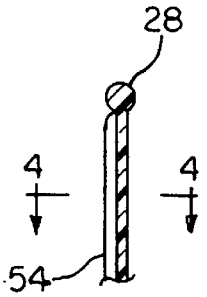
FIG. 3 is a cross-sectional view of a portion of the cap insert as viewed along line 3—3 in FIG. 2.

Referring to FIG. 3, this view shows a portion of the sheet in cross section, and in particular shows the preferred circular cross section for cord 28. A side view of a portion of rib 54 is also shown.

Figure 4:
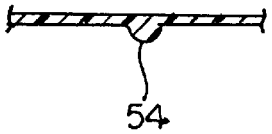
FIG. 4 is a cross-sectional view of a portion of the cap insert as viewed along line 4—4 in FIG. 3.

Referring to FIG. 4, this view shows the preferred semicircular cross section for rib 54.

The following are some preferred dimensions for the sheet of the cap insert described above, which should not be construed to limit the broad aspects of the invention in any manner: diameter of cord and rib cross sections of about ⅛ inch; thickness of the sheet in noncorded and nonribbed areas of about 1/32 inch; central width of about 3–4 inches, most preferably about 3 ½ inches: leg width of about ½–1 inch, most preferably about ⅝–⅞ inch; length of central sheet portion 32 of about 6 ½–7 ½ inches, most preferably about 7 inches; length of tapered sheet portions 40 and 48 of about 1 ½–4 ¾ inches, most preferably about 2 ¾ inches; length of leg sheet portions 44 and 52 of about 1–4 ½ inches, most preferably about 3 ¼ inches; and an overall length between ends 12 and 14 of about 18–20 inches, most preferably about 19 inches.

The above-mentioned overall length is preferred in order to fit virtually all billed caps having sweatbands. The sweatband can have an arcuate distance from end to end ranging from about 15 ½ inches to about 19 inches. Therefore, the sweatband of a particular cap can be measured, and an appropriate length of leg sheet portions 44 and 52 can be cut off with scissors, if necessary, to fit the sweatband.

Figure 5:
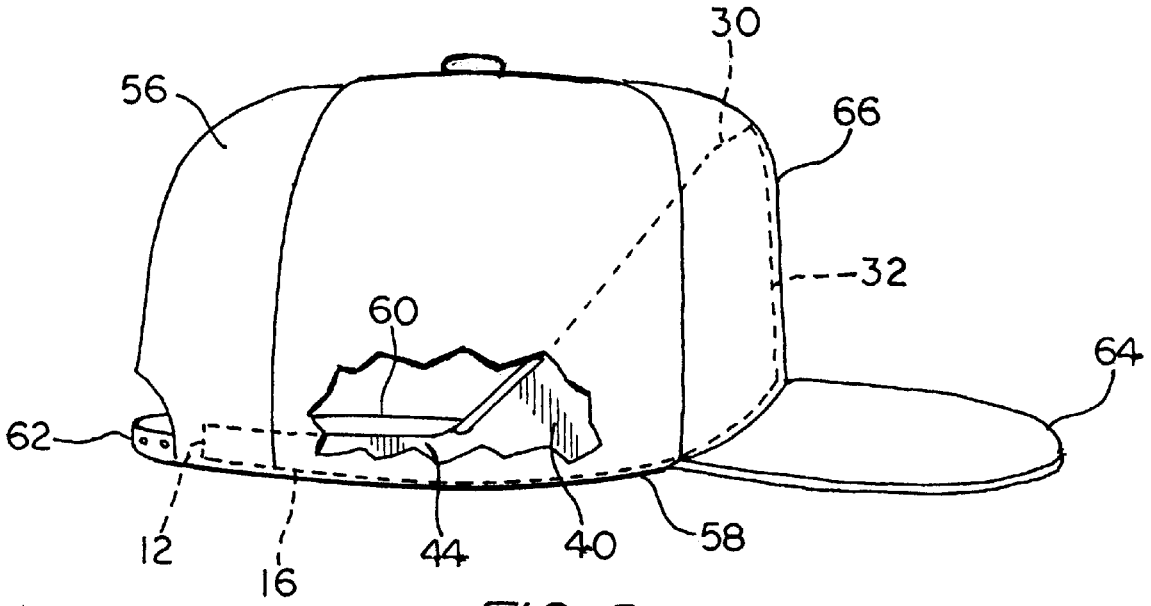
FIG. 5 is a side view of a billed cap with a portion of its head covering broken away to show portions of the cap insert therein and also a portion of the cap sweatband.

Referring to FIG. 5, the illustrated billed cap includes a head covering 56 having a head covering edge 58, a sweatband 60 inside head covering 56, an adjustment strap 62, and a bill 64 extending from head covering edge 58 adjacent to a front portion 66 of head covering 58.

With regard to the cap insert as installed in the billed cap, sheet edge 16 is positioned immediately adjacent to head covering edge 58 between head covering 58 and sweatband 60. Sheet end 12 is near or at one end of sweatband 60 adjacent to adjustment strap 62. This prevents undesired circumferential movement of the cap insert in the billed cap during normal wear. As shown, the width of leg sheet portion 44, the leg width, is preferably less than the width of sweatband 60. Central sheet portion 32 is immediately adjacent to or in contact with the inner surface of front head covering portion 66, and extends from sheet edge 16 to central edge portion 30 near or at the top of front head covering portion 66. Tapered sheet portion 40 functions primarily to brace or support central sheet portion 32 and thereby prevent the undesired inward curvature of front head covering portion 66. The proper shape of front head covering portion 66, as maintained by the cap insert of the invention, is clearly evident in FIG. 5. Although not shown, the other half of the cap insert extends around the unshown half of the billed cap in the same manner as described above.

Figure 6:
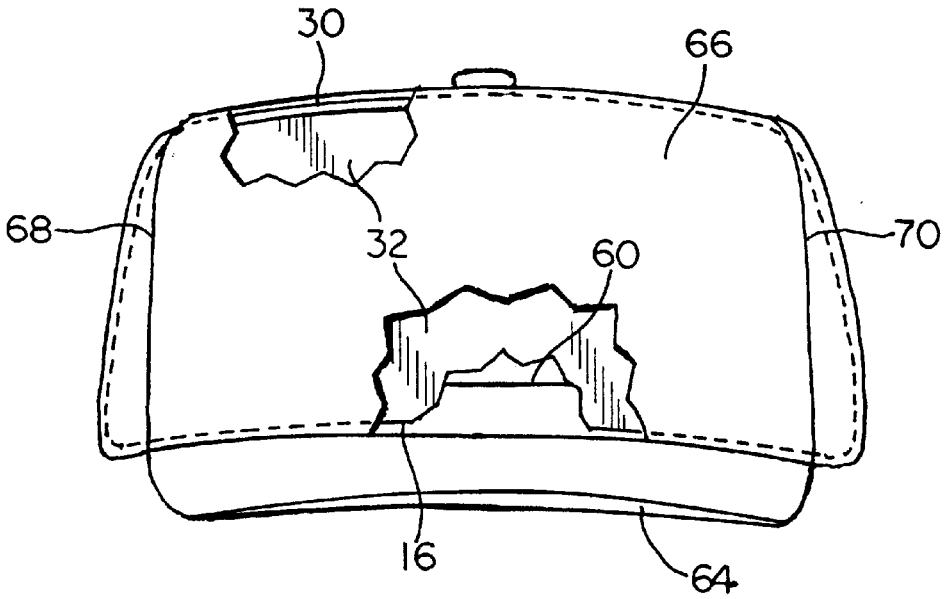
FIG. 6 is a front view of the billed cap of FIG. 5 with other portions of its head covering broken away to show another portion of the cap insert. A portion of the cap insert is also broken away to show another portion of the sweatband.

Referring to FIG. 6, this view shows the manner in which central edge portion 30 extends substantially across front head covering portion 66 between seams 68 and 70. The surface of central sheet portion 32 shown in FIG. 1 is facing the inner surface of front head covering portion 66, and the opposing surface of central sheet portion 32 (having ribs 54) faces rearwardly and is not visible in FIG. 6. Sweatband 60 is shown as extending behind central sheet portion 32, with sheet edge 16 between front head covering portion 66 and sweatband 60.

The cap insert can be easily removed from the billed cap in order to wash the cap, or to place into another billed cap as the user desires.

Obviously, many modifications and variations of the present invention are possible in light of the above teachings. It is, therefore, to be understood that within the scope of the appended claims, the invention may be practiced otherwise than as specifically described.

That which is claimed is:

1. A cap insert comprising an elongated sheet having a longitudinal axis, being flexible but sufficiently rigid for use as a shaping insert in a billed cap, and being substantially planar in a relaxed state, wherein the sheet includes:

longitudinally opposed ends;

a substantially straight first edge longitudinally extending between the ends; and a second edge extending between the ends and transversely spaced from the first edge, wherein the second edge has (i) a longitudinally extending, continuous, and unbroken central edge portion centrally positioned with respect to the first edge and the ends so as to define a central sheet portion, having a central width, between the central edge portion and first edge, and (ii) longitudinally opposed and substantially identical side edge portions, wherein each side edge portion has (a) a tapered side edge subportion extending outwardly from the central edge portion so as to define a tapered sheet portion between the tapered side edge subportion and first edge which decreases in width from the central width to a width hereafter denoted as the leg width, and (b) a longitudinally extending leg side edge subportion extending outwardly from the tapered side edge subportion to an end so as to define a leg sheet portion, having the leg width, between the leg side edge subportion and first edge.

2. A cap insert as recited in claim 1 wherein the central edge portion is substantially straight.

3. A cap insert as recited in claim 1 wherein the sheet is a plastic material.

4. A cap insert comprising an elongated sheet having a longitudinal axis, being flexible but sufficiently rigid for use as a shaping insert in a billed cap, and being substantially planar in a relaxed state, wherein the sheet includes:

longitudinally opposed ends;

a substantially straight first edge longitudinally extending between the ends; and a second edge extending between the ends and transversely spaced from the first edge, wherein the second edge has (i) a longitudinally extending central edge portion centrally positioned with respect to the first edge and the ends so as to define a central sheet portion, having a central width, between the central edge portion and first edge, and (ii) longitudinally opposed and substantially identical side edge portions, wherein each side edge portion has (a) a tapered, substantially straight side edge subportion extending outwardly from the central edge portion so as to define a tapered sheet portion between the tapered side edge subportion and first edge which decreases in width from the central width to a width hereafter denoted as the leg width, an obtuse angle of about 120–150° being defined between the central edge portion and the tapered side edge subportion, and (b) a longitudinally extending leg side edge subportion extending outwardly from the tapered side edge subportion to an end so as to define a leg sheet portion, having the leg width, between the leg side edge subportion and first edge.

5. A cap insert as recited in claim 4 wherein the angle is about 130–140°.

6. A cap insert comprising an elongated sheet having a longitudinal axis, being flexible but sufficiently rigid for use as a shaping insert in a billed cap, and being substantially planar in a relaxed state, wherein the sheet includes:

longitudinally opposed ends;

a substantially straight first edge longitudinally extending between the ends; and a second edge extending between the ends and transversely spaced from the first edge, wherein the second edge has (i) a longitudinally extending central edge portion centrally positioned with respect to the first edge and the ends so as to define a central sheet portion, having a central width, between the central edge portion and first edge, and (ii) longitudinally opposed and substantially identical side edge portions, wherein each side edge portion has (a) a tapered side edge subportion extending outwardly from the central edge portion so as to define a tapered sheet portion between the tapered side edge subportion and first edge which has a length and which decreases in width from the central width to a width hereafter denoted as the leg width, the ratio of the length of the tapered sheet portion to said decrease in width being about 0.5–1.7:1, and (b) a longitudinally extending leg side edge subportion extending outwardly from the tapered side edge subportion to an end so as to define a leg sheet portion, having the leg width, between the leg side edge subportion and first edge.

7. A cap insert as recited in claim 6 wherein said ratio is about 0.8–1.2:1.

8. A cap insert comprising an elongated sheet having a longitudinal axis, being flexible but sufficiently rigid for use as a shaping insert in a billed cap, and being substantially planar in a relaxed state, wherein the sheet includes:

longitudinally opposed ends;

a first edge longitudinally extending between the ends; and a second edge extending between the ends and transversely spaced from the first edge, wherein the second edge has (i) a longitudinally extending central edge portion, having a central width, centrally positioned with respect to the first edge and the ends so as to define a central sheet portion between the central edge portion and first edge having transversely extending and longitudinally spaced ribs, and (ii) longitudinally opposed and substantially identical side edge portions, wherein each side edge portion has (a) a tapered side edge subportion extending outwardly from the central edge portion so as to define a tapered sheet portion between the tapered side edge subportion and first edge which decreases in width from the central width to a width hereafter denoted as the leg width, and (b) a longitudinally extending leg side edge subportion extending outwardly from the tapered side edge subportion to an end so as to define a leg sheet portion, having the leg width, between the leg side edge subportion and first edge.

9. A cap insert as recited in claim 5 wherein a cord defines the central edge portion and tapered side edge subportion.

10. A cap insert as recited in claim 9 wherein the thickness of the sheet in noncorded and nonribbed areas is about 1/32 inch.

11. A cap insert comprising an elongated sheet having a longitudinal axis, being flexible but sufficiently rigid for use as a shaping insert in a billed cap, and being substantially planar in a relaxed state, wherein the sheet includes:

longitudinally opposed ends;

a first edge longitudinally extending between the ends; and a second edge extending between the ends and transversely spaced from the first edge, wherein the second edge has (i) a longitudinally extending central edge portion centrally positioned with respect to the first edge and the ends so as to define a central sheet portion, having a central width of about 3–4 inches, between the central edge portion and first edge, and (ii) longitudinally opposed and substantially identical side edge portions, wherein each side edge portion has (a) a tapered side edge subportion extending outwardly from the central edge portion so as to define a tapered sheet portion between the tapered side edge subportion and first edge which decreases in width from the central width to a width of about ½–1 inch, hereafter denoted as the leg width, and (b) a longitudinally extending leg side edge subportion extending outwardly from the tapered side edge subportion to an end so as to define a leg sheet portion, having the leg width, between the leg side edge subportion and first edge.

12. A cap insert comprising an elongated sheet having a longitudinal axis, being flexible but sufficiently rigid for use as a shaping insert in a billed cap, and being substantially planar in a relaxed state, wherein the sheet includes:

longitudinally opposed ends;

a first edge longitudinally extending between the ends; and a second edge extending between the ends and transversely spaced from the first edge, wherein the second edge has (i) a longitudinally extending central edge portion centrally positioned with respect to the first edge and the ends so as to define a central sheet portion, having a central width, between the central edge portion and first edge, and (ii) longitudinally opposed and substantially identical side edge portions, wherein each side edge portion has (a) a tapered side edge subportion extending outwardly from the central edge portion so as to define a tapered sheet portion between the tapered side edge subportion and first edge which decreases in width from the central width to a width hereafter denoted as the leg width, and (b) a longitudinally extending leg side edge subportion extending outwardly from the tapered side edge subportion to an end so as to define a leg sheet portion, having the leg width, between the leg side edge subportion and first edge;

wherein the length of the central sheet portion is about 6 ½–7 ½ inches, the length of each tapered sheet portion is about 1 ½–4 ¾ inches, the length of each leg sheet portion is about 1–4 ½ inches, and the overall length of the sheet between the ends is about 18–20 inches.

* * * * *